United States Patent [19]

Grant

[11] Patent Number: 4,708,273

[45] Date of Patent: Nov. 24, 1987

[54] CONTAINER HOLDER

[76] Inventor: Brian T. Grant, 1282 E. 48th St., Los Angeles, Calif. 90011

[21] Appl. No.: 896,308

[22] Filed: Aug. 12, 1986

Related U.S. Application Data

[63] Continuation of Ser. No. 712,588, Mar. 15, 1985, abandoned.

[51] Int. Cl.[4] ..... A45F 5/00

[52] U.S. Cl. ..... 224/252; 220/85 H; 224/148

[58] Field of Search ..... 220/85 R, 85 H; 224/148, 240, 247, 248, 251, 252, 253, 268, 269, 224, 242, 226, 270, 42.45, 42.42; 248/311.2

[56] References Cited

U.S. PATENT DOCUMENTS

| | | | |
|---|---|---|---|
| D. 272,775 | 2/1984 | Weissenburger | 224/148 X |
| D. 276,760 | 12/1984 | Kesterson | 224/148 X |
| 1,556,127 | 10/1925 | Pruett | 224/247 X |
| 1,605,195 | 11/1926 | Lewis | 224/148 |
| 1,611,275 | 12/1926 | Lewis | 224/247 X |
| 1,782,962 | 11/1930 | Hobbs | 220/85 H |
| 2,289,701 | 7/1942 | Engel et al. | 248/311.2 |
| 2,926,879 | 3/1960 | Dietrich | 224/42.45 R |
| 3,369,723 | 2/1968 | Saari et al. | 224/148 |
| 3,380,635 | 4/1968 | Stone et al. | 224/148 |
| 3,734,439 | 5/1973 | Wintz | 224/274 X |
| 4,299,345 | 11/1981 | Lanzl | 224/252 |
| 4,363,432 | 12/1982 | Warthen | 224/252 X |
| 4,535,923 | 8/1985 | Manke | 224/273 |
| 4,606,523 | 8/1986 | Statz et al. | 220/85 H X |
| 4,634,089 | 1/1987 | Wright et al. | 248/311.2 |

*Primary Examiner*—James E. Bryant, III
*Assistant Examiner*—Robert M. Petrik
*Attorney, Agent, or Firm*—Nilsson, Robbins, Dalgarn, Berliner Carson and Wurst

[57] ABSTRACT

A holder attachable to a person's belt supports an open drink container in an upright condition so that the container can be removed to consume its contents. In a preferred embodiment, the container is a wide-mouthed container with a removable lid and the holder has an upper retaining portion for reception of the container in a downward direction to a preselected operative position. A lower stop portion carried with the retaining portion engages the bottom of the container in the operative position thereof to support the weight of the container. An intermediate portion can also be provided between the retaining portion and the stop portion to press inwardly against the container and stabilize it against substantially lateral forces.

1 Claim, 4 Drawing Figures

FIG. 1
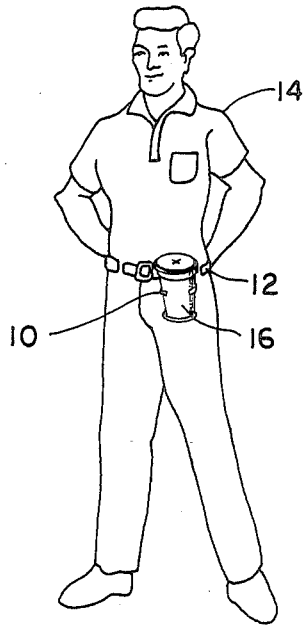
FIG. 2
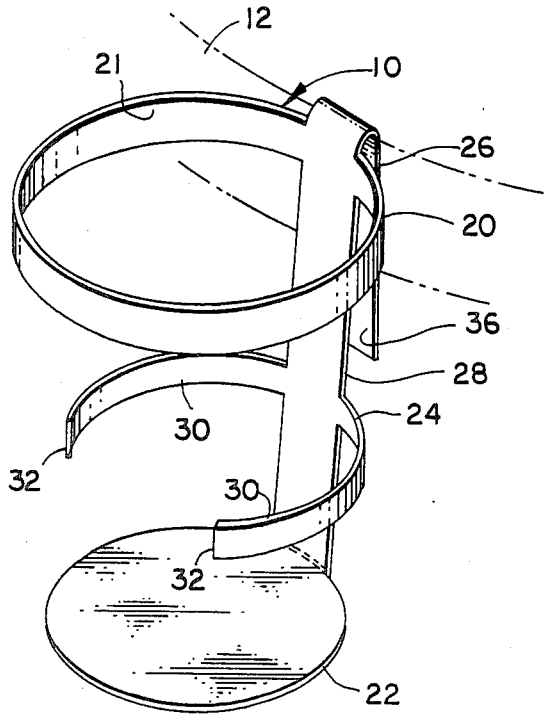
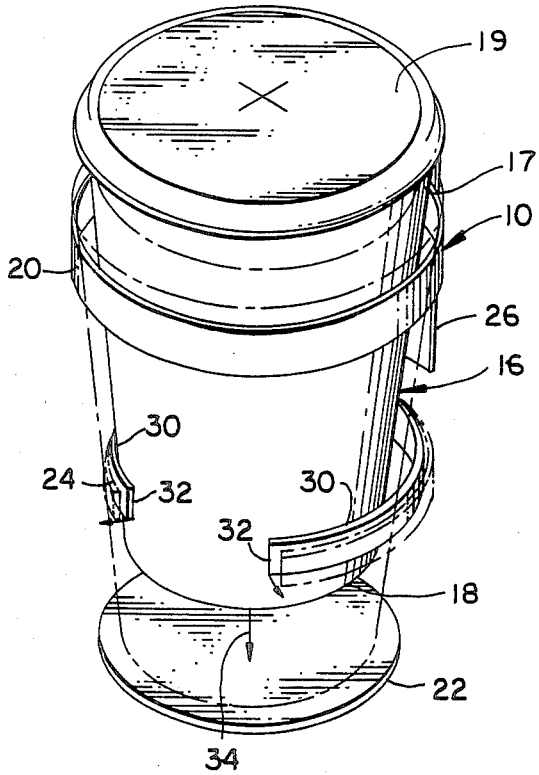
FIG. 3
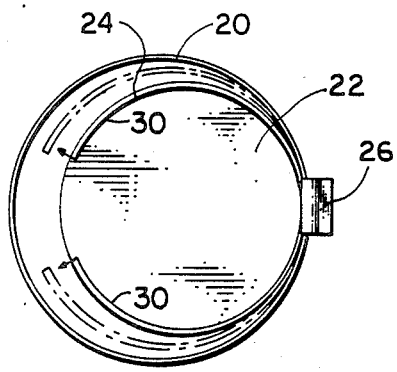
FIG. 4

CONTAINER HOLDER

This is a continuation of co-pending application Ser. No. 712,588 filed on Mar. 15, 1985, now abandoned.

BACKGROUND OF THE INVENTION

The present invention relates to the container art and, more particularly, to a device for carrying an open drink container on a person's belt.

The handling of drink containers, particularly at athletic events, amusement parks and recreational facilities, poses significant problems to the consumer. For example, drinks sold in disposable cups at sporting events are difficult to carry when one or both of the consumer's hands are needed to hold other items, such as food, coats, tickets, binoculars or the like, or to negotiate stairs and other obstacles. A person attempting to carry a drink and a number of other articles can spill the drink, drop the articles he is carrying, or stumble and fall if he pays too much attention to the drink.

Persons engaged in sports or exercise programs also encounter container handling problems. Such persons include, most notably, bicycle riders and long distance walkers. Bicycle riders mount bottles or cans to the frames of bicycles, but the points of attachment are usually below the waist of the rider and are difficult to reach while riding.

Therefore, it is desirable in many circumstances to provide an improved method for consumers to handle open drink containers.

SUMMARY OF THE INVENTION

The present invention relates to a device for carryino a drink container on a person's belt, comprising: a structure for receiving an open drink container in a supporting relationship so that the container is maintained in a substantially upright condition and can be withdrawn to consume a drink therein; and a structure for attaching the container receiving structure to a belt. In a preferred embodiment, the container receiving structure comprises: an upper retaining portion defining an aperture for reception of the container in a downward direction to a preselected operative position; and a lower stop portion carried with the upper retaining portion and engageable with the bottom of the container to support its weight when the container is in the operative position. In a further embodiment, the upper retaining portion may be a ring extending about the upper end of the container to support it against substantially lateral forces and the device may include an intermediate portion having a pair of opposed arms carried between the upper retaining portion and the lower stop portion to stabilize the container against substantially lateral forces.

The device of the present invention is suitable for holding a variety of containers, including wide-mouthed containers such as cups or glasses having removable lids. It permits an open drink container to be carried in a stable upright condition on a person's belt, freeing the person's hands to carry other articles and perform other tasks. This makes it much easier to carry a drink and reduces the chance of a spill. The device also makes the consumption of drinks safer in some circumstances, such as when the consumer is carrying other articles, negotiating stairs, or riding a bicycle. In any of these circumstances, the consumer can easily reach down to the height of his belt to take a drink.

The device of the present invention is also simple and inexpensive to manufacture, making it feasible to distribute it in large quantities in connection with the sale of drinks.

BRIEF DESCRIPTION OF THE DRAWINGS

The above and other features of the present invention may be more fully understood from the following detailed description, together with the accompanying drawings, wherein similar reference characters refer to similar elements throughout and which:

FIG. 1 is an isometric view of a person using a holder constructed according to a preferred embodiment of the present invention to carry a drink container;

FIG. 2 is an isometric view of the container holder of FIG. 1, in isolation;

FIG. 3 is an isometric view of the container holder of FIG. 1, with a container in the process of being inserted therein; and FIG. 4 is a reduced top plan view of the container holder of FIG. 1, in isolation.

DESCRIPTION OF THE PREFERRED EMBODIMENT

Referring now to FIGS. 1, 2, 3, and 4, which illustrate a preferred embodiment of the present invention, a holder 10 is attached to a belt 12 of a person 14 to carry a drink container 16.

The container 16 is typically "open" in the sense that it is in a condition suitable for consumption of its contents and must be maintained substantially upright to prevent spilling. The container 16 is preferably a beverage cup which tapers downwardly from an upper end 17 to a bottom 18, with the upper end covered by a removable lid 19. In that case, the cup may have a straw (not shown) extending through the lid to facilitate consumption of the contents. Alternatively, the container may be an open "pop-top" beverage can.

The holder 10 comprises an upper retaining portion 20 which defines an aperture 21 for downward reception of the container 16, a lower stop portion 22 which supports the weight of the container, and an intermediate portion 24 which stabilizes the container against lateral forces. Thus, the container can be moved to and from a preselected operative position within the holder 10 by a simple vertical motion, allowing the container to be removed periodically for consumption of its contents. Attachment of the holder to the wearer's belt is accomplished by a tab 26 that slips over the belt.

Referring specifically to FIG. 2, the upper retaining portion 20 in the preferred embodiment is a continuous ring which closely engages the upper end of the container. The diameter of the aperture 21 of the retaining portion is then at least as great as the diameter of the portion of the container that it contacts. Such contact is typically made to the side walls of the container near its upper end 17. The lower stop portion 22, which is illustrated as a circular disk-type element, may take any other suitable form able to support the weight of the container. The stop portion is connected to the upper retaining portion 20 by a stem 28 which extends downwardly from the upper retaining portion at a location near the tab 26.

The intermediate portion 24 has a pair of arms 30 extending arcuately from the stem 28 at a point between the upper retaining portion 20 and the lower stop portion 22. The arms 30 combine to form a partial circle terminating in free ends 32 and are spaced sufficiently far apart to receive the bottom 18 of the container 16 therebetween (FIG. 3). When the container 16 is a downwardly tapering cup, the arms 30 are cammed outwardly by the side walls of the container as the container is lowered into the holder 10. The arms 30 are resilient to provide an inward stabilizing force on the walls of the container when the container is seated within the holder.

FIG. 3 illustrates the covered container 16 as it is inserted into the holder 10 in a downward direction 34, and shows the seated or "operative" position of the container in phantom lines. The final, outwardly displaced positions of the arms 30 are also shown in phantom lines in FIGS. 3 and 4.

The tab 26, by which the holder 10 is attached to the wearer's belt 12, extends substantially rearwardly and downwardly relative to the upper retaining portion 20 to define a downwardly opening slot 36. The holder is installed by slipping the tab downwardly over the belt 12 so that the belt is received within the slot 36. In the preferred embodiment, the tab 26 is merely an extension of the stem 28. However, it may take the form of any other suitable attaching means, such as a loop defining a lateral opening through which the belt 12 can be received.

The holder 10 is preferably made of a suitable organic polymeric material, such as conventional "plastics", to form the unitary body illustrated in the drawing figures. In that case, the device is typically manufactured by injection molding. Alternatively, the holder can be fabricated from one or more pieces of sheet metal. In either case, the holder can be produced quite inexpensively, enabling it to be distributed in large quantities as a convenience or promotional item.

From the above, it can be seen that there has been provided a device for easily and safely carrying a drink container on a person's belt while permitting the container to be removed periodically for consumption of its contents. Thus, the device frees the hands and arms of the user for other purposes.

The appended claims are not limited to the embodiments described herein, but rather are intended to cover all variations and adaptations falling within the true scope and spirit of the present invention. For example, the structure of the holder 10 and the method of attaching it to the wearer's belt may be varied considerably without reducing the advantages inherent in the device. Likewise, the container 16 is not necessarily a cup, but may be an open can, glass or other container from which a drink is consumed. When the container 16 is a glass or other wide-mouthed container, a cover in the nature of the lid 19 should be provided.

What is claimed is:

1. A device for carrying on a person's belt a fragile, disposable cup having walls tapered from an upper end of a first preselected diameter to a lower end of a smaller second preselected diameter, said device being a one-piece molded structure comprising:

a retaining portion defining an aperture for reception of the cup in a downward direction to a preselected operative position, the retaining portion comprising a substantially rigid ring which has a diameter at least as great as the first preselected diameter and extends around the upper end of the cup when the cup is in said operative position;

stem portion having one end connected to said ring;

a stop portion connected to the opposite end of said stem portion and carried below the retaining portion and engageable with the lower end of the cup to support its weight when the cup is in said operative position;

a pair of opposed resilient arms the stem portion and curved to define an opening in alignment with said aperture and having a diameter at least as great as the second preselected diameter before the cup is placed in said operative position;

the arms being actuable outwardly by the walls of the cup as the cup is moved downwardly to said operative position, so that the arms press inwardly against the walls of the cup to receive the cup snugly in said operative position; and means for attaching the device to a belt of a user without removing said belt comprising a tab portion in alignment with said stem portion extending substantially rearwardly and downwardly from a preselected location on the ring to define a downwardly opening slot for reception of the belt.

* * * * *

UNITED STATES PATENT AND TRADEMARK OFFICE

CERTIFICATE OF CORRECTION

PATENT NO. : 4,708,273

DATED : November 24, 1987

INVENTOR(S) : Brian T. Grant

It is certified that error appears in the above-identified patent and that said Letters Patent is hereby corrected as shown below:

IN THE SPECIFICATION:

Column 1, line 34, delete "carryino" and insert --carrying--.

IN THE CLAIMS:

Column 4, line 28, insert --extending from a central point of-- before the words "the stem portion".

Signed and Sealed this

Twelfth Day of July, 1988

*Attest:*

*Attesting Officer*

DONALD J. QUIGG

*Commissioner of Patents and Trademarks*